US010245854B2

(12) United States Patent
Flotats Vilagrasa et al.

(10) Patent No.: US 10,245,854 B2
(45) Date of Patent: Apr. 2, 2019

(54) DETERMINING PRINTER PLATEN TYPE

(71) Applicant: HEWLETT-PACKARD DEVELOPMENT COMPANY, L.P., Houston, TX (US)

(72) Inventors: Carles Flotats Vilagrasa, Barcelona (ES); Francesc Melia Sune, Palma de Mallorca (ES); David Toussaint, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/546,092

(22) PCT Filed: Apr. 8, 2015

(86) PCT No.: PCT/US2015/024937
§ 371 (c)(1),
(2) Date: Jul. 25, 2017

(87) PCT Pub. No.: WO2016/164012
PCT Pub. Date: Oct. 13, 2016

(65) Prior Publication Data

US 2018/0022116 A1 Jan. 25, 2018

(51) Int. Cl.
*B41J 11/02* (2006.01)
*B41J 11/06* (2006.01)
*B41J 13/00* (2006.01)

(52) U.S. Cl.
CPC ..... *B41J 11/06* (2013.01); *B41J 13/0009* (2013.01)

(58) Field of Classification Search
CPC ... B41J 11/02; B41J 11/06; B41J 11/20; B41J 11/18
See application file for complete search history.

(56) References Cited

U.S. PATENT DOCUMENTS

| | | | | |
|---|---|---|---|---|
| 4,315,461 | A | 2/1982 | Harpold | |
| 5,397,192 | A | 3/1995 | Khormaee | |
| 6,760,132 | B1 * | 7/2004 | Shibata | H04N 1/04 358/474 |
| 7,413,301 | B2 | 8/2008 | Niimi et al. | |
| 7,591,602 | B2 | 9/2009 | Fukumasu et al. | |
| 8,020,957 | B2 | 9/2011 | Kayanaka | |
| 2004/0179081 | A1 * | 9/2004 | Nimi | B41J 2/01 347/104 |
| 2007/0188578 | A1 * | 8/2007 | Kayanaka | B41J 3/28 347/104 |

(Continued)

FOREIGN PATENT DOCUMENTS

| | | |
|---|---|---|
| JP | 06262822 | 9/1994 |
| JP | 2005103937 | 4/2005 |
| JP | 2007106000 | 4/2007 |

(Continued)

*Primary Examiner* — Geoffrey S Mruk
*Assistant Examiner* — Scott A Richmond
(74) *Attorney, Agent, or Firm* — Dierker & Kavanaugh PC

(57) ABSTRACT

In one example, a printer having a removably-installable platen. The platen has a platen type. A surface of the platen has a feature that is indicative of the platen type. The printer includes a single platen-type-discriminating sensor. The sensor detects a distinguishing characteristic of the feature. A controller determines the platen type from the distinguishing characteristic.

13 Claims, 5 Drawing Sheets

(56) References Cited

U.S. PATENT DOCUMENTS

| | | | | |
|---|---|---|---|---|
| 2007/0212146 | A1* | 9/2007 | Lyons | B41J 3/60 400/82 |
| 2009/0056582 | A1* | 3/2009 | Mizutani | B41J 3/4078 101/484 |

FOREIGN PATENT DOCUMENTS

| | | |
|---|---|---|
| JP | 2007160813 | 6/2007 |
| JP | 2010046859 | 3/2010 |

* cited by examiner

DETERMINING PRINTER PLATEN TYPE

BACKGROUND

Many printers deposit a colorant (such as, for example, a printing fluid, which in some cases may be an ink) on a substrate (i.e. a print medium). During printing, in some types of printers including, for example, inkjet printers, at least the portion of the substrate that is currently being printed is placed on a platen of the printer. The platen positions the substrate at the proper location within the printer to ensure that the resulting print output on the substrate will be of high-quality. The set of substrate types can be diverse, and include paper, mylar, vinyl, and textiles, among others. Different substrate types often have different colorant-receiving properties. In some cases, these properties determine or affect the characteristics of a platen to optimally receive and handle the substrate. Accordingly, a printer may support many different types of interchangable platens, which may be removably installed in the printer based on the type of substrate to be printed.

DETAILED DESCRIPTION

Figure 1:
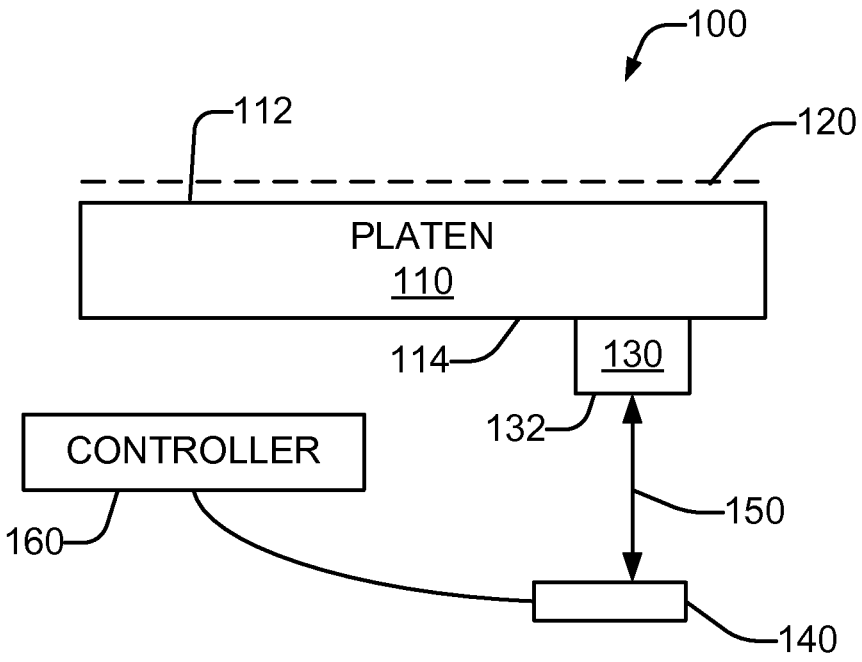
FIG. 1 is a schematic representations of a printer including a platen type sensor and removably installed platen, in accordance with an example of the present disclosure.

As defined herein and in the appended claims, a "platen" may be broadly understood to mean a component which supports at least a portion of a substrate in a proper position within the printer for printing, when that substrate portion is being printed. Some types of platens may also provide additional functionality for the substrate.

In this regard, different types of platens may have substrate-receiving surfaces with different mechanical characteristics. A non-limiting set of examples are as follows. A platen used for printing on vinyl substrates which do not significantly expand during printing and which are not permeable by the colorant may have a flat surface. A platen used for printing on substrates such as paper which may expand or cockle when wetted by the colorant may have ridges or valleys to accommodate the expansion while still holding the surface of the media relatively flat. A platen used for printing on textiles, whose permeability allows some of the colorant to bleed through the substrate, may have a colorant collector (also known as a "gutter" or "spittoon"), such as absorbent foam, to capture and hold the bled-through colorant. In some cases, up to about 50% of the colorant may bleed through the substrate to the platen.

Different types of platens may also provide substrate-handling functionalities. A non-limiting set of examples are as follows. A platen used for printing on some substrates may apply a vacuum force through the substrate in order to hold the substrate flat against the platen when printing. A platen may conduct heat to the substrate in order to preheat the medium to make it more receptive to the colorant. A platen may be moveable to assist with the flow of the substrate through the printer.

Referring now to the drawings, there is illustrated an example of a printer constructed in accordance with the present disclosure which includes a platen, a single sensor, and a controller. The platen is removably installable in the printer, and is selected from a set of platens in which different platens may have different platen types. The platen includes a feature indicative of the platen type. The sensor detects a distinguishing characteristic of the feature, and the controller determines the platen type from the distinguishing characteristic. The single sensor can detect, and discriminate between, all of the different types of platens that are installable in the printer.

Considering now a printer, and with reference to FIG. 1, a printer 100 includes a platen 110. The platen 110 may receive a substrate and maintain it at a position 120 with respect to a surface 112 of the platen 110. Although the position 120 is illustrated for clarity as adjacent to the surface 112, in many cases the position 120 abuts the surface 112. The platen 110 is removably installable in the printer 100, and is interchangeable with other platens. Other installable platens are chosen from a set of platens which have different platen types. The platen 110 may be replaced with another platen of the same platen type or a different platen type.

The platen 110 includes a surface having a feature 130 that is indicative of the platen type. The feature 130 may be formed in, or protrude from, the surface. The surface may be the surface 112, or a different surface 114, of the platen 110. In FIG. 1, surface 114 is opposite surface 112, and the feature 130 is a protrusion outward from surface 114.

The printer 100 also includes a sensor 140. In examples, the sensor 140 is a single, platen-type-discriminating sensor. The sensor 140 detects a distinguishing characteristic of the feature 130. The same single sensor 140 is usable to discriminate among any of the different platen types in the set of platens. In one example, the sensor 140 is spaced apart from the platen 110 at a stationary position within the printer during a sensing operation. In one example, the distinguishing characteristic is a distance 150 between the sensor 140 and a surface 132 of the feature 130 when the platen 110 is properly installed in the printer 100.

In some examples, the platen-type-discriminating sensor 140 is a distance-measuring sensor. In one example, the distance-measuring sensor 140 may be an acoustical sensor. One example acoustical sensor is an ultrasonic sensor. An ultrasonic sensor transmits and receives sound waves, and uses the time interval between the transmission and the reception to determine the distance 150. Some ultrasonic sensors can determine a different in distance of as little as one millimeter. By directing the ultrasonic transmission towards the surface 132 of the feature 130, and by arranging the geometry of the surface 132 such that it reflects the ultrasonic transmission back to the sensor 140, the distance 150 between the sensor 140 and the surface 132 can be accurately measured. In one example, the feature 130 may have a surface 132 that is substantially flat, and all at the same distance 150, within the area of reflection. In many examples, the size of the feature 130 is significantly smaller than how it is illustrated in FIG. 1 for clarity.

In some examples, ultrasound sensors are not adversely affected by colorant aerosol, drops of a colorant such as ink which may disperse within the printer and accumulate on component surfaces.

In other examples, the sensor 140 may be an optical sensor or an electronic sensor. Example optical sensors include laser interferometer sensors and laser triangulation sensors. Example electrical sensors include capacitive displacement sensors, eddy current sensors, and inductive sensors.

The printer 100 further includes a controller 160 that is communicatively coupled to the sensor 140. The controller 160 receives electrical signals from the sensor 140 that correspond to the distinguishing characteristic, and determines the platen type from the distinguishing characteristic. In an example where the distinguishing characteristic is the distance 150, the distance 150 (and thus the electrical signals from the sensor 140) is different for each different platen type.

Considering now another printer, and with reference to FIG. 2, a printer 200 prints on a substrate 202 in web form as it flows past at least one printhead 220. The substrate 202 may be a web of continuous media of a particular width in the form of a roll 204 mounted on a supply reel 205. A feeder mechanism 206 applies an appropriate tension to the substrate as it wraps around a drive roller 208. A pinch wheel 209 pinches the substrate against the drive roller 208 to create a point of traction and put the substrate in a controlled or known position.

Platen 210 is the same as or similar to platen 110 (FIG. 1), and the substrate 202 passes adjacent, or against, the platen 210. A vacuum source 260 is the platen 210 by a plenum 265. The vacuum source 260 creates suction in direction 262. In one example, the platen 210 is perforated, and the suction urges the substrate 202 against the surface of the platen 210 in order to maintain the substrate 202 at the proper position relative to the printhead 220 during printing. The proper position may be, for example, a predetermined distance 222 from the printhead in the direction above the plane of the substrate 202.

Various printheads 220 may apply different types of colorants to the substrate 202 in direction 224. One type of colorant is latex ink. Latex inks are often used for industrial printing, such as for signage, to greatly improve the durability and sun resistance of the signage as compared to water-based pigmented or dye-based inks. After a printhead 220 deposits latex ink on the substrate 202, heat is applied to the substrate 202 by a heat source 270 as the substrate is positioned adjacent a secondary platen 275. The heat from the heat source 270 polymerizes the deposited ink, rendering the printed images scratch-, rain-, and sun-resistant. Because the distance from the heat source 270 to the substrate 202 during polymerization need not be as tightly controlled as the distance from the printhead, no vacuum is applied to the secondary platen 275.

From the secondary platen 275, the substrate 202 is tensioned by a tension bar 280, and then wound into a roll 282 on a take-up reel 284 by a rewinder 286. In the case where a short run (for example, one to two meters) of the substrate is supplied for printing, the substrate may bypass the tension bar 280 and rewinder 286, instead being allowed to fall freely when it exits the secondary platen 275.

The platen 210 includes a feature 230 and a platen-type-discriminating sensor 240. The feature 230 and sensor 240 are the same as or similar to the feature 130 and the sensor 150 (FIG. 1). The sensor 240 is positioned within the plenum 265. The distance 250 between the sensor 240 and a surface of the feature 230 when the platen 210 is properly installed in the printer 200 is the distinguishing characteristic for determining the type of the platen 210

Illustrated in dashed lines are an alternative feature 230', and a corresponding alternative platen-type-discriminating sensor 240'. In some examples, the alternative feature 230' and sensor 240' exist in place of the feature 230 and sensor 240. The sensor 240' may be the same as the sensor 240, but it is positioned external to the plenum 265 rather than internal to it. Locating the sensor external to the plenum 265 simplifies the plenum 265 by reducing or eliminating cabling that passes through a wall of the plenum 265 from the sensor to a controller. This, in turn, eliminates expensive machining of the plenum to accommodate the cabling, and air leaks that may occur in the plenum at the cabling sites.

Figure 2A:
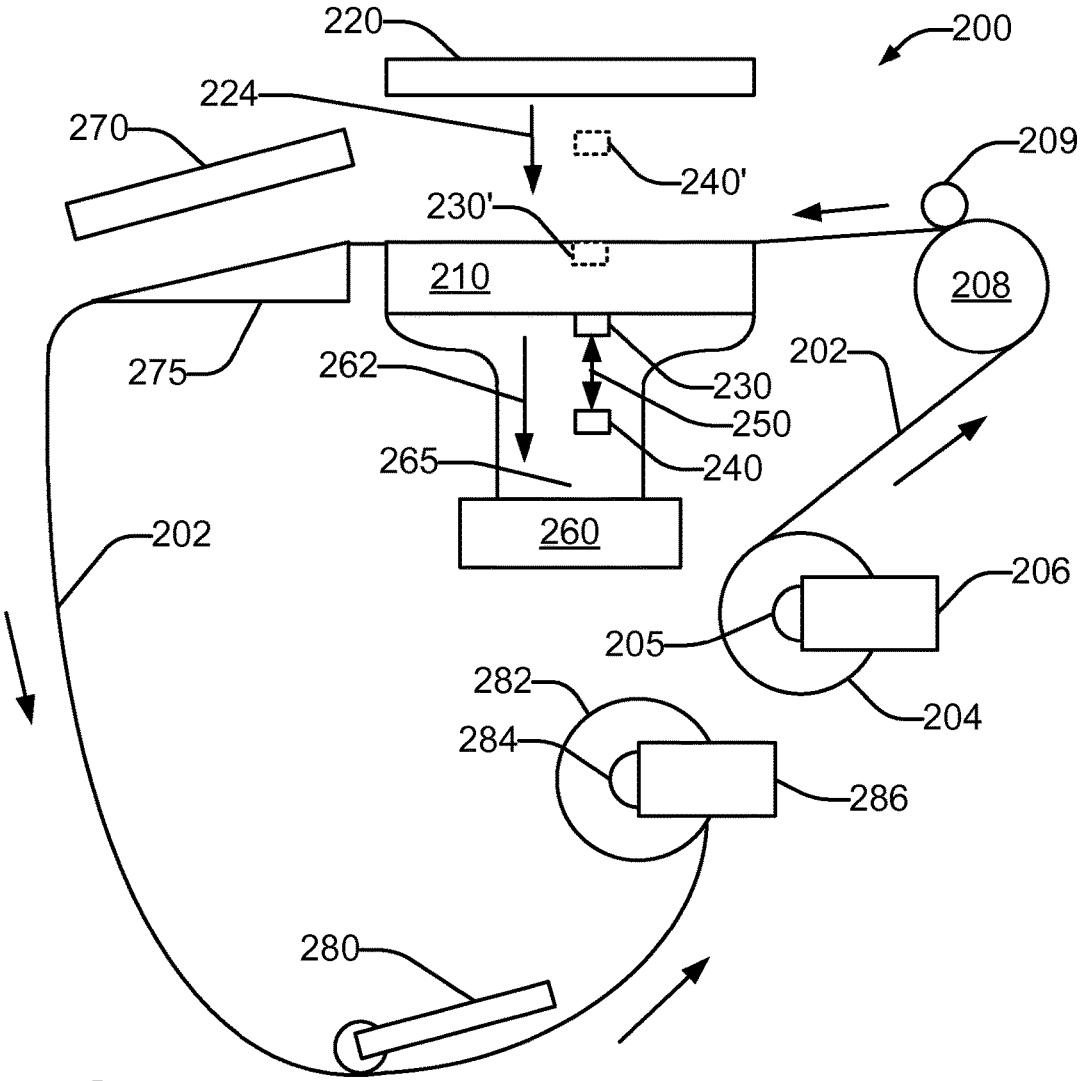
FIG. 2A is a schematic representations of another printer including a platen type sensor and a removably installed platen which is properly installed, in accordance with an example of the present disclosure.
Figure 2B:
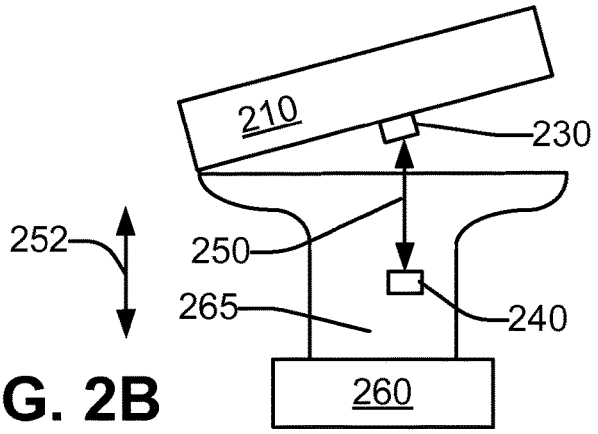
FIG. 2B is a schematic representations of the printer of FIG. 2A with the platen improperly installed, in accordance with an example of the present disclosure.

FIG. 2A illustrates the platen 210 in a properly-installed position. For example, the bottom surface of the platen 210 may abut the plenum 265. However, and with reference to FIG. 2B, it is possible that the platen may be improperly installed. For example, the platen 210 may first engage one side of the plenum 265 and then be rotated into its proper position, where it may then be latched so as to be retained in the proper position. In one example, in order to ensure that an improper installation of the platen 210 will be detected, the plenum 210 or plenum 265 may be provided with a resilient feature such as a spring (not shown), which will urge at least a part of the platen 210 upwards unless it is properly latched.

When the platen 210 is in the upward, improperly-installed position, the feature 230 will be disposed at a greater distance from the sensor 240 than when the platen 210 is in the properly-installed position. A predetermined range of properly-installed platen distances 252 is known to the controller. The predetermined range 252 is sufficiently wide such that the properly-installed distance 250 associated with each of the different platen types falls within the range 252. If the distance 250 falls outside the range 252, the controller identifies the platen 210 as being improperly-installed, and may inform the operator of this condition and/or prevent operation of the printer 200 unless the platen 210 is properly installed.

Figure 3:
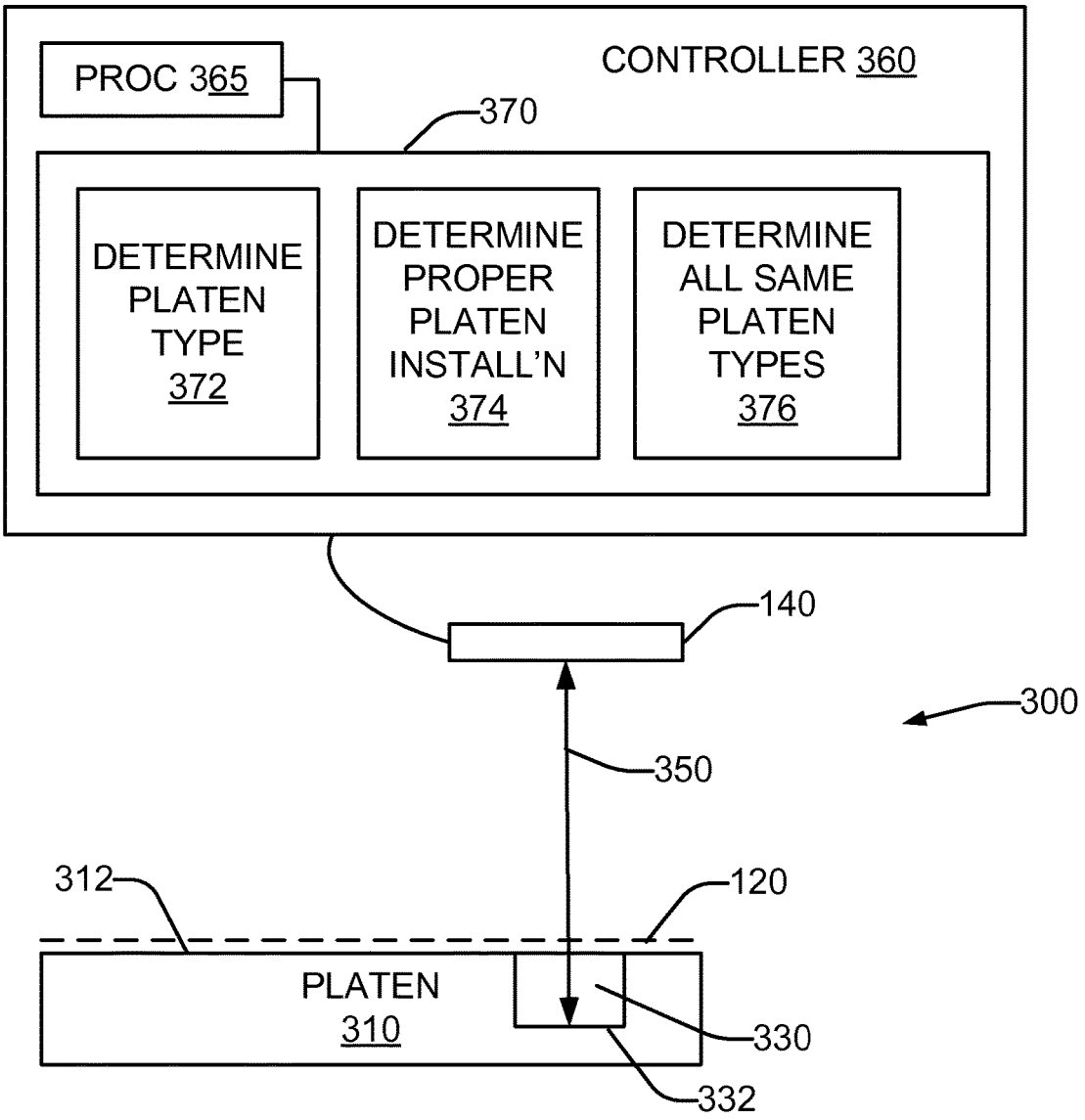
FIG. 3 is a schematic representations of another printer including a platen type sensor and removably installed platen, in accordance with an example of the present disclosure.

Considering now in greater detail another printer, and with reference to FIG. 3, a printer 300 includes a platen 310 in which the feature 330 does not project or protrude outward from a surface 312 of the platen 310, but instead is a void or depression formed in the surface 312 of the platen 310. This structure of the feature 330 allows the received substrate to be positioned at 120 adjacent to or abutting the surface 312 without interference from the feature 330. Where the platen-type-discriminating sensor 140 is a distance-measuring sensor, the sensor 140 measures a distance 350 between the sensor 140 and a distal surface 332 of the feature 330. In one example, the surface 132 substantially flat, and all at the same distance 350 from the sensor 140 within the sensor's area of reflection. In many examples, the size of the feature 330 is significantly smaller than how it is illustrated in FIG. 3 for clarity.

The sensor 140 is communicatively coupled to a controller 360. In one example, the controller 360 is firmware-based and includes a processor 365 which is communicatively coupled to a memory 370. The memory 370 includes processor-readable and -executable instructions usable by the controller 360. These instructions may be organized into executable modules and routines. One example routine 372 determines the platen type from the distinguishing characteristic provided by the sensor 140. Another example routine 374 determine whether the platen is installed properly or improperly. Where the printer includes multiple installed platens as will be discussed subsequently with reference to FIG. 4, a further example routine 376 determines whether all of the multiple installed platens are of the same platen type.

In other examples, the controller 360 may be implemented in hardware, and/or implemented in whole or in part in an external computer communicatively coupled to the printer 300.

Figure 4:
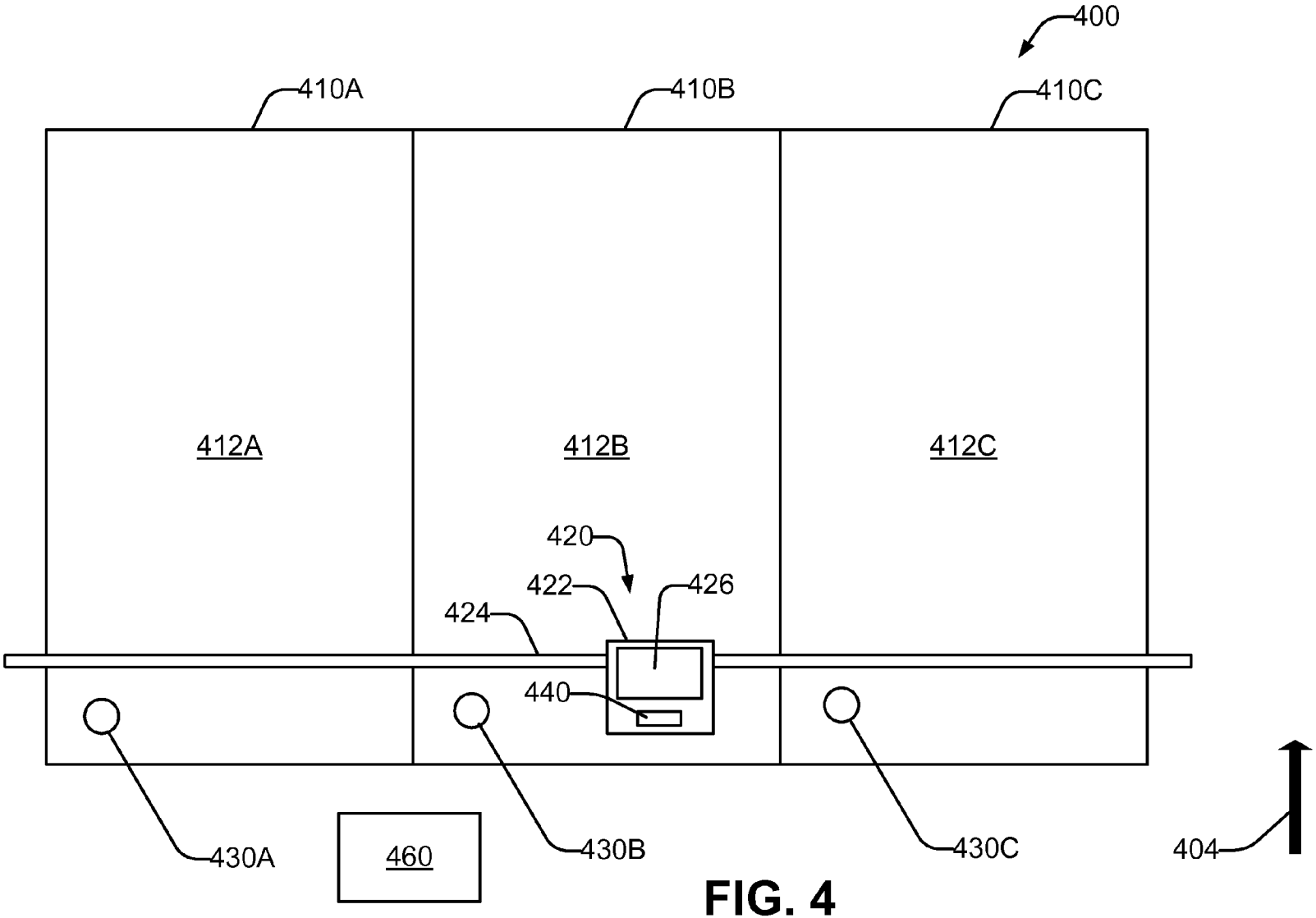
FIG. 4 is a schematic representations of a printer having multiple removably installed platens, in accordance with an example of the present disclosure.

Considering now another printer, and with reference to FIG. 4, a printer includes multiple removably installable platens. For example, the printer 400 has three platens 410A-C, having substrate-receiving surfaces 412A-C respectively. The substrate flows adjacent or abutting the surfaces 412A-C in direction 404 for printing. The platens 410A-C collectively span the entire printable width of the substrate in a direction orthogonal to direction 404. For example, if a platen 410 has a 32-inch width, then the three platens 410A-C can collectively print on a 96-inch wide substrate.

The printer 400 includes at least one printhead arrangement 420. A number of different types of printhead arrangements 420 may be used with the platens 410A-C. One printhead arrangement 420 includes a carriage 422 slidably engaged with a slider bar 424. The carriage 422 reciprocates along the slider bar 424 as instructed by the controller 460 in order to print any position in the printable width of the substrate. The carriage 422 includes at least one printhead 426. In one example, different printheads have different color colorants, and the colorant from multiple printheads can be used in varying proportions to print a range of colors. In one example, a printhead 426 uses inkjet technology to controllably deposit drops of the colorant onto the substrate as instructed by the controller 460.

In other examples, a printhead arrangement 420 may be a substrate-wide print arrangement that can print any position in the printable width of the substrate without reciprocation of a carriage.

An individual platen 410A-C includes a corresponding feature 430A-C. In examples, a feature 430 is located at the same position in the plane of the surface 412 for all platens 410A-C. The feature 430A-C may be detected by a corresponding fixed-position sensor (not shown). In one example, an individual feature 430A-C is the same as or similar to features 130, 230', 330, and each fixed-position sensor is the same as or similar to sensors 140, 240', 340, as described heretofore with reference to FIGS. 1-3.

In another example, the carriage 422 includes a moveable sensor 440. The sensor 440 may be affixed to the carriage 422, and thus movable relative to the platens 410A-C as the carriage 422 is reciprocated. When the feature 430 is to be detected, the carriage 422 moves the sensor 440 over the feature 430. The carriage 422 may move the sensor 400 over the complete span of the feature 430. In one example, the moveable sensor 440 is an optical line sensor which has a light source oriented to emit a light beam toward the platen 410A-C, and a light-sensitive detector aligned to detect light that is reflected from the platen. In one example, the feature 430 detected by a moveable line sensor 440 is a different type of feature from features 130, 230', 330. The feature 430 may be a region of the surface 412A-C which has a particular color that is different for each platen type. The feature 430 may be a contrasting pattern of lines (e.g. a bar code) formed on the platen surface 412A-C. Detecting the feature 430 with a moveable line sensor 440 may be accomplished by making a series of sensor measurements while the sensor 440 is moved by the carriage 422 across or over the feature 430. The resulting series of output measurements can then be processed by the controller 460 (which is the same as or similar to controller 360, FIG. 3) coupled to the sensor 440 so as to detect the color and/or pattern of lines (i.e. the distinguishing characteristic) in order to determine the platen type, and/or whether the platen is properly installed.

The connections between the controller 460 and the sensor 440, the carriage 422, and the printheads are omitted from FIG. 4 for clarity of illustration In some cases, the various platens include a mechanical lockout feature which ensures that all platens 410A-C installed in the printer 400 are of the same platen type. However, in other cases, such a lockout feature is absent from the platens, and so a user could install a set of platens 410A-C which are not all of the same platen type. If the platens were to be of different types, some of the platens might not be suitable for use with the substrate. This could result in incorrect placement of the colorant on the substrate that degrades image quality; uncontrolled cockeling of the substrate; friction which leads to wrinkles in the substrate; and/or crashes of the wrinkled substrate into the carriage and/or printheads. Accordingly, in one example, the controller 460 prevents printing operations of the printer 400 unless all of the platens 410A-C have the same platen type. Furthermore, in one example, the controller 460 prevents printing operations of the printer 400 if any of the platens 410A-C are improperly installed in the printer 400. If a platen is improperly installed, the carriage and/or the printheads might crash into the platen during movement, with the carriage and/or the printheads being damaged or destroyed.

Figure 5:
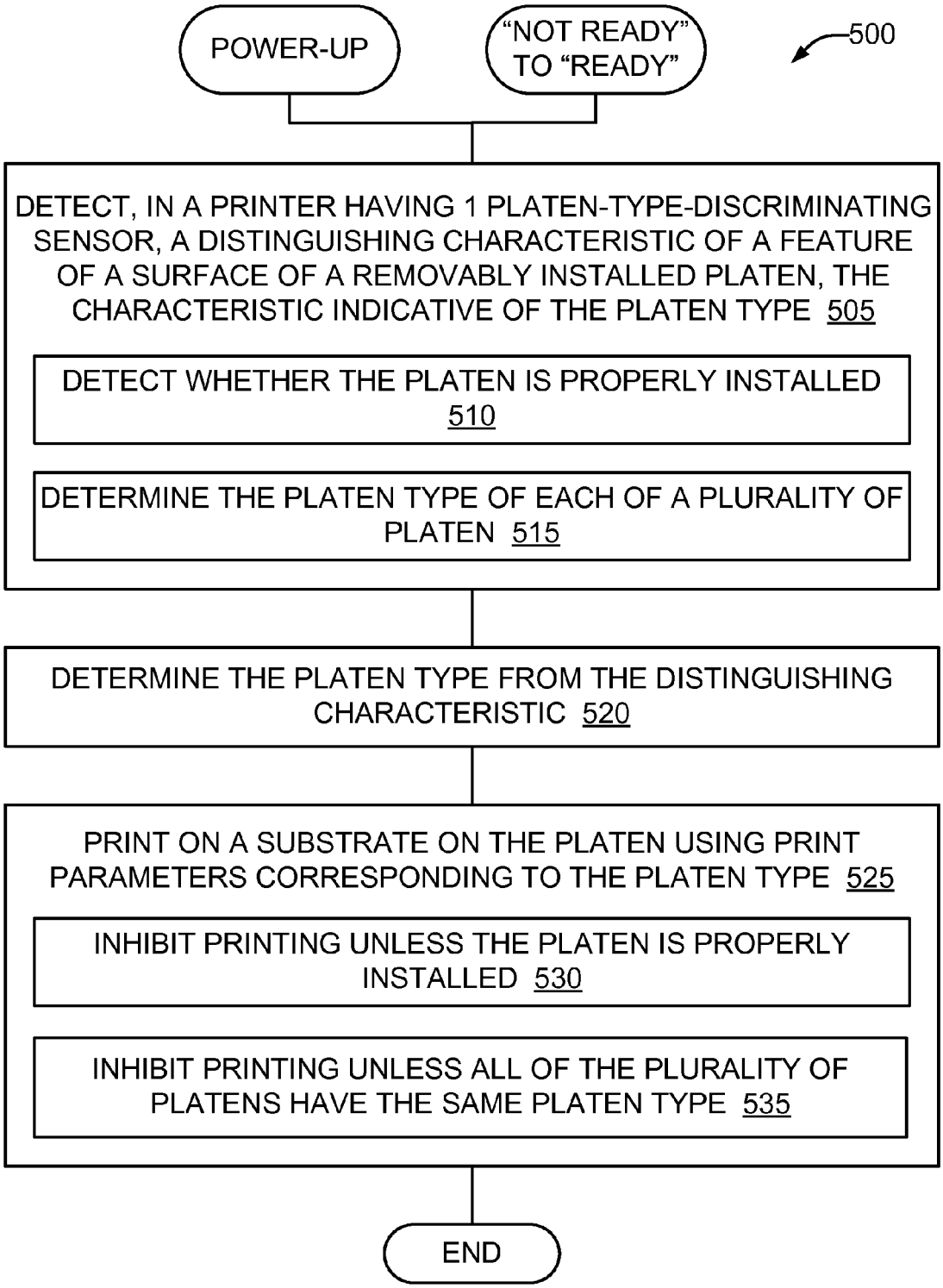
FIG. 5 is a flowchart in accordance with an example of the present disclosure of a method of printing usable with the printers of FIGS. 1-4

Consider now, and with reference to FIG. 5, one example method 500 of printing with a printer having a single platen-type-discriminating sensor. Alternatively, the flowchart of FIG. 5 may be considered as at least a portion of a method implemented in a controller of such a printer. The method 500 may be initiated responsive to the printer being powered on. The method 500 may also be initiated responsive to an intended transition of the printer from a "not ready" state to a "ready" state. In the "not ready" state, printing is inhibited and, in some examples, movement of the printheads and/or the carriage(s) is also prohibited. Printing operations, including movements of the printheads and/or the carriage(s), are allowed when the printer is in the "ready" state. The printer may enter a "not ready" state when, for example, an access door into the printer is opened, and/or when a platen is unlatched. In some examples, the method 500 may also be initiated manually by a user. It may also be initiated automatically in a periodic manner, in response to a print request, or at other times or in response to other events.

At 505, a distinguishing characteristic of a feature of a surface of a platen that is removably installed in the printer is detected. The distinguishing characteristic is indicative of the platen type. In some examples, a platen may be one of at least three different platen types. The distinguishing characteristic is detected using the single platen-type-discriminating sensor of the printer.

In some examples, at 510, it is detected, using the sensor, whether the platen is properly installed or improperly installed. In some examples, at 515, the platen type is determined for a plurality of different platens installed in the printer.

At 520, the platen type is determined from the distinguishing characteristic. The determining may be performed using a controller of the printer.

At 525, a substrate on or adjacent the platen is printed using print parameters which correspond to the platen type. At 530, in some examples, printing is inhibited unless all platens in the printer are properly installed. At 535, in some examples, printing is inhibited unless all of the platens installed in the printer have the same platen type.

Terms of orientation and relative position (such as "top," "bottom," "side," and the like) are not intended to indicate a particular orientation of any element or assembly, and are used for convenience of illustration and description. In some examples, at least one block discussed herein is automated. In other words, apparatus, systems, and methods occur automatically. As defined herein and in the appended claims, the terms "automated" or "automatically" (and like variations thereof) shall be broadly understood to mean controlled operation of an apparatus, system, and/or process using computers and/or mechanical/electrical devices without the necessity of human intervention, observation, effort and/or decision.

From the foregoing it will be appreciated that the printed and methods provided by the present disclosure represent a significant advance in the art. Although several specific examples have been described and illustrated, the disclosure is not limited to the specific methods, forms, or arrangements of parts so described and illustrated. This description should be understood to include all novel and non-obvious combinations of elements described herein, and claims may be presented in this or a later application to any novel and non-obvious combination of these elements. The foregoing examples are illustrative, and different features or elements may be included in various combinations that may be claimed in this or a later application. Unless otherwise specified, steps of a method claim need not be performed in the order specified. Similarly, blocks in diagrams or numbers should not be construed as steps that must proceed in a particular order. Additional blocks/steps may be added, some blocks/steps removed, or the order of the blocks/steps altered and still be within the scope of the disclosed examples. Further, methods or steps discussed within different figures can be added to or exchanged with methods or steps in other figures. Further yet, specific numerical data values (such as specific quantities, numbers, categories, etc.) or other specific information should be interpreted as illustrative for discussing the examples. Such specific information is not provided to limit examples. The disclosure is not limited to the above-described implementations, but instead is defined by the appended claims in light of their full scope of equivalents. Where the claims recite "a" or "a first" element of the equivalent thereof, such claims should be understood to include incorporation of at least one such element, neither requiring nor excluding two or more such elements. Where the claims recite "having", the term should be understood to mean "comprising".

What is claimed is:

1. A printer, comprising:

a first platen removably installable in the printer and having a platen type;

a surface of the first platen having a first feature indicative of the platen type;

a platen-type-discriminating first sensor, the first sensor to detect a first distinguishing characteristic of the first feature; and a controller to determine the platen type from the first distinguishing characteristic, wherein the first sensor is further to detect whether the first platen is properly installed in the printer, and wherein the controller is further to prevent operation of the printer unless the first platen is properly installed in the printer.

2. The printer of claim 1, wherein the first sensor is spaced apart from a substrate-receiving surface of the first platen at a stationary position within the printer during a sensing operation.

3. The printer of claim 1, wherein a spacing between a planar surface of the first feature and the first sensor is different for different types of properly-installed platens.

4. The printer of claim 3, wherein the first sensor is an ultrasonic sensor spaced apart from the first platen, and wherein the first distinguishing characteristic is a distance from the ultrasonic sensor to the first feature when the first platen is properly installed in the printer.

5. The printer of claim 1, wherein the first sensor is an ultrasonic sensor, wherein the first feature is disposed at a first distance from the ultrasonic sensor when the first platen is properly installed in the printer, and at a second distance from the ultrasonic sensor when the first platen is improperly installed in the printer;

wherein the first sensor is to further determine a measured distance between the ultrasonic sensor and the first feature, and wherein the controller is further to prevent operation of the printer if the measured distance is the second distance.

6. The printer of claim 1, wherein the first sensor is a line sensor spaced apart from the surface, and wherein a pattern or a color of the first feature is different for different platen types.

7. The printer of claim 6, wherein the line sensor is mounted on a scanning carriage of the printer which moves relative to the surface during a sensing operation.

8. The printer of claim 1, further comprising:

a second platen removably installable in the printer, the second platen having a same platen type as the first platen;

a second feature indicative of the platen type disposed at a surface of the second platen in a location that is the same for all platen types;

a platen-type-discriminating second sensor, the second sensor to detect a second distinguishing characteristic of the second feature of the second platen, the second distinguishing characteristic indicative of the platen type; and wherein the controller is further to prevent operation of the printer unless the first platen and the second platen are of the same platen type.

9. The printer of claim 8, wherein a substrate printable by the printer has a width, wherein each of the first platen and the second platen spans a portion of the width, and wherein a plurality of platens including the first platen and the second platen collectively spans the width.

10. The printer of claim 8, wherein the first sensor is further to detect whether the first platen is properly installed in the printer, wherein the second sensor is further to detect whether the second platen is properly installed in the printer; and wherein the controller is further to prevent operation of the printer unless both of the first platen and the second platen are properly installed in the printer.

11. A printer, comprising:

a first platen removably installable in the printer and having a platen type;

a surface of the first platen having a first feature indicative of the platen type;

a platen-type-discriminating first sensor, the first sensor to detect a first distinguishing characteristic of the first feature;

a controller to determine the platen type from the first distinguishing characteristic;

a second platen removably installable in the printer, the second platen having a same platen type as the first platen;

a second feature indicative of the platen type disposed at a surface of the second platen in a location that is the same for all platen types;

a platen-type-discriminating second sensor, the second sensor to detect a second distinguishing characteristic of the second feature of the second platen, the second distinguishing characteristic indicative of the platen type; and wherein the controller prevents operation of the printer unless the first platen and the second platen are of the same platen type.

12. The printer of claim 11, wherein a substrate printable by the printer has a width, wherein each of the first platen and the second platen spans a portion of the width, and wherein a plurality of platens including the first platen and the second platen collectively spans the width.

13. The printer of claim 11, wherein the first sensor is further to detect whether the first platen is properly installed in the printer, wherein the second sensor is further to detect whether the second platen is properly installed in the printer; and wherein the controller is further to prevent operation of the printer unless both of the first platen and the second platen are properly installed in the printer.

* * * * *